US005419997A

United States Patent [19]

Hirano

[11] Patent Number: 5,419,997

[45] Date of Patent: May 30, 1995

[54] METHOD FOR PROCESSING SILVER HALIDE PHOTOGRAPHIC MATERIAL

[75] Inventor: Mitsunori Hirano, Kanagawa, Japan

[73] Assignee: Fuji Photo Film Co., Ltd., Kanagawa, Japan

[21] Appl. No.: 205,734

[22] Filed: Mar. 4, 1994

[30] Foreign Application Priority Data

Mar. 5, 1993 [JP] Japan ..... 5-045176

[51] Int. Cl.[6] ..... G03C 1/06

[52] U.S. Cl. ..... 430/264; 430/598; 430/435; 430/436; 430/437; 430/438; 430/442; 430/456

[58] Field of Search ..... 430/264, 598, 435, 436, 430/437, 438, 442, 456

[56] References Cited

U.S. PATENT DOCUMENTS

| | | | |
|---|---|---|---|
| 3,276,875 | 10/1966 | Schwalenstocker | 430/483 |
| 3,615,440 | 10/1971 | Bloom et al. | 430/249 |
| 3,865,591 | 2/1975 | Katz | 430/437 |
| 3,870,479 | 3/1975 | Kubotera et al. | 430/456 |
| 4,975,354 | 12/1990 | Machonkin et al. | 430/264 |
| 4,994,365 | 2/1991 | Looker et al. | 430/598 |
| 5,104,769 | 4/1992 | Looker et al. | 430/264 |
| 5,236,816 | 8/1993 | Purol et al. | 430/435 |
| 5,264,323 | 11/1993 | Purol et al. | 430/264 |
| 5,284,732 | 2/1994 | Nii et al. | 430/264 |

*Primary Examiner*—Thomas R. Neville
*Attorney, Agent, or Firm*—Sughrue, Mion, Zinn, Macpeak & Seas

[57] ABSTRACT

A method for processing a silver halide photographic material is disclosed and the photographic material has a support thereon, comprising at least one silver halide emulsion layer and containing a hydrazine compound represented by following formula (I) in the above emulsion layer or the other hydrophilic colloid layers, which comprises processing the silver halide photographic material after exposure in a developing solution containing:

(1) 0.2 to 0.75 mole/liter of a dihydroxybenzene developing agent, (2) 0.001 to 0.06 mole/liter of a 1-phenyl-3-pyrazolidone or p-aminophenol auxiliary developing agent, (3) 0.3 to 1.2 mole/liter of a free sulfite ion, and (4) a compound represented by following formula (II), and having a concentration ratio of a compound represented by formula (II) to a dihydroxy developing agent of 0.03 to 0.12 and pH of 9.0 to 11.0:

(I)

(II)

8 Claims, No Drawings

METHOD FOR PROCESSING SILVER HALIDE PHOTOGRAPHIC MATERIAL

FIELD OF THE INVENTION

The present invention relates to a method for processing a silver halide photographic material to form a superhard photographic image used in a field of a graphic art.

BACKGROUND OF THE INVENTION

In the field of the graphic art, a system for forming a superhard photographic image having an image portion clearly distinguished from a non-image portion is required in order to obtain a good dot image, character and line image.

The formation of the superhard photographic image has been carried out by using a specific developing solution called "lith" developing solution over a long period of time. In the system using this "lith" developing solution, it is essential to maintain a concentration of a free sulfite ion in a developing solution at very low level in.order to allow the performance thereof to be revealed. Since sulfite ion acts as a preservative, the problem is involved that the "lith" developing solution lacks for a stability and has a keen aging deterioration.

An alternative process for processing a surface latent image type silver halide light-sensitive material containing a hydrazine compound which is developed in a superadditive type developing solution having Ph 11.0 to 12.3 and containing a sulfite preservative in a high concentration, is proposed in U.S. Pat. No. 4,166,742. Said process forms a superhard photographic image with a stable developing solution.

The process made it possible to improve in a stability of a developing solution with the sulfite preservative of a high concentration, but a developing solution having a relatively high Ph value has to be used in order to obtain the superhard photographic image and that makes the developing solution liable to be subjected to air oxidation. Accordingly, there has been tried a device for realizing a superhard photographic image-forming system utilizing a nucleus-forming development with a hydrazine compound in a developing solution of lower Ph.

A process, where an amino compound promoting a hardening action of a hydrazine compound is added to a developing solution, is proposed in U.S. Pat. No. 4,269,929 (JP-A-61-267759 (the term "JP-A" as used herein means an unexamined published Japanese patent application)) as a process for obtaining a hard image with a developing solution of a lower Ph value.

The processes using various hydrazine compounds having a high hardening action are also proposed in U.S. Pat. No. 4,737,452 (JP-A-60-179734), U.S. Pat. Nos. 5,104,769, and 4,798,780.

There is proposed in JP-A-l-179939 and JP-A-1-179940, a process where a nucleus-forming accelerator having an adsorption group to silver halide is used in combination with a hydrazine compound having an adsorptio group.

Further, in U.S. Pat. Nos. 4,998,604 and 4,994,365, the processes using a hydrazine compound having a repeating unit of ethylene oxide and a hydrazine compound having a pyridinium group in combination, are proposed.

However, various processes described above have a problem that a black pepper is liable to be induced. The black pepper (called as well pepper fog) used herein is a black spot generated at a portion which is a non-developed portion between the dots. It is liable to generate when a light-sensitive material is stored under a high temperature and a high humidity or when a fatigued developing solution is used. The black pepper is a trouble by which a commercial value is seriously lowered.

On the other hand, in U.S. Pat. No. 3,865,591, a developing solution using three kinds of developing agents which comprise dihydroxybenzenes, 3-pyrazolidones and ascorbic acid or the derivative thereof are disclosed in combination. However, it is not taught in this publication to process a silver halide light-sensitive material containing a hydrazine compound in the developing solution. Further, a developing solution containing ascorbic acid in a high proportion, which is used in the examples thereof, inhibits a nucleus-forming development using the hydrazine compound.

SUMMARY OF THE INVENTION

An object of the present invention is to provide a method for processing a silver halide light-sensitive material, by which a superhard photographic image can be formed using a developing solution having as low Ph as 9.0 to 11.0, without suffering from a black pepper.

The above object has been solved by the method according to the present invention:

A method for processing a silver halide photographic material having a support thereon comprising at least one silver halide emulsion layer and containing a hydrazine compound represented by the following formula (I) in the above emulsion layer or the other hydrophilic colloid layers, which comprises processing the silver halide photographic material after exposing in a developing solution containing:

(1) 0.2 to 0.75 mole/liter of a dihydroxybenzene developing agent, (2) 0.001 to 0.06 mole/liter of a 1-phenyl-3-pyrazolidone and/or p-aminophenol auxiliary developer, (3) 0.3 to 1.2 mole/liter of a free sulfite ion, and (4) a compound represented by the following Formula (II), and having a concentration ratio of the compound represented by Formula (II) to the dihydroxy series developer of 0.03 to 0.12 and Ph of 9.0 to 11.0:

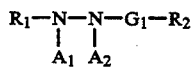

$$R_1-\underset{\underset{A_1}{|}}{N}-\underset{\underset{A_2}{|}}{N}-G_1-R_2 \qquad (I)$$

wherein $R_1$ represents an aliphatic group, an aromatic group, or a heterocyclic group; $R_2$ represents a hydrogen atom, an alkyl group, an aryl group, an alkoxy group, an aryloxy group, an amino group, or a hydrazino group; $G_1$ represents a carbonyl group, a sulfonyl group, a sulfoxy group, a —P(O)($R_3$)— group ($R_3$ is synonymous with $R_2$), a —C(O)C(O)— group, a thiocarbonyl group, or an iminomethylene group; and both of $A_1$ and $A_2$represent a hydrogen atom, or either of them represents a hydrogen atom and another represents an alkylsulfonyl group, an arylsulfonyl group, or an acyl group:

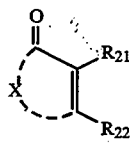

(II)

wherein $R_{21}$ and $R_{22}$ each represents a hydroxy group, an amino group, an acylamino group, an alkylsulfonylamino group, an arylsulfonylamino group, an alkoxycarbonylamino group, a mercapto group, or an alkylthio group; and X represents an atomic group necessary to form a 5- to 6-membered ring together with two vinyl carbon atoms substituted with $R_{21}$ and $R_{22}$ and a carbonyl carbon atom.

DETAILED DESCRIPTION OF THE INVENTION

The hydrazine compound used in the present invention will be explained below in detail.

In formula (I), the group represented by $R_1$ is an aliphatic group having the carbon number of 1 to 30 and particularly is a linear, branched or cyclic alkyl group having the carbon number of preferably 1 to 20. The alkyl group may be substituted.

The aromatic group represented by $R_1$ is a monocyclic or dicyclic aryl group or un-saturated heterocyclic group having 4 to 60 carbon atoms, inclusive of the substituents, preferably 4 to 30 carbon atoms, wherein the unsaturated heterocyclic group may be condensed with an aryl group. Preferred as $R_1$ is an aryl group, particularly preferably the aryl group containing a benzene ring. The aryl group may further be substituted.

In the case where $R_1$ is the aliphatic group or the aromatic group, the example of substituent includes, for example, an alkyl group, an alkenyl group, an alkynyl group, an alkoxy group, an aryl group, a substituted amino group, a ureido group, a urethane group, an aryloxy group, a sulfamoyl group, a carbamoyl group, an alkyl- or arylthio group, an alkyl- or arylsulfonyl group, an alkyl- or arylsulfinyl group, a hydroxy group, a halogen atom, a cyano group, a sulfo group, an aryloxycarbonyl group, an acyl group, an alkoxycarbonyl group, an acyloxy group, a carbonamide group, a sulfonamide group, a carboxyl group, a phosphoric amido group, a diacylamino group, an imido group, and a $R_4$—NHC(O)N($R_5$)C(O)group ($R_4$ and $R_5$ are selected from the same groups as those defined for $R_2$ and may be different from each other). The preferred substituents include an alkyl group (preferably that having carbon number of 1 to 20 and in case of an aralkyl group, one having preferably carbon number of 7 to 30), an alkoxy group (preferably that having carbon number of 1 to 20), a substituted amino group (preferably an amino group substituted with an alkyl group having carbon number of 1 to 20), an acylamino group (preferably that having carbon number of 2 to 30), a sulfonamide group (preferably that having carbon number of 1 to 30), a ureido group (preferably that having carbon number of 1 to 30), and a phosphoric amide group (preferably having carbon number of 1 to 30). These groups may further be substituted.

Further, it may have a group containing —O—$(CH_2CH_2O)_n$—, —O—$(CH_2CH(CH_3)O)_n$—, or—O—$(CH_2CH(OH)CHO)_n$— (n is an integer of 3 or more) as a part of a substituent, or a quaternary ammonium cation as a part of a substituent.

The hetero ring in $R_1$ is a 3- to 10-membered saturated or unsaturated hetero ring containing at least one of N, O or S atom, which may form a single ring or a condensed ring with the other aromatic or hetero ring. A 5- to 6-membered aromatic heterocyclic group is preferred as the hetero ring, and preferred are those containing, for example, a pyridine group, an imidazolyl group, a quinolinyl group, a benzimidazolyl group, a pyrimidyl group, a pyrazolyl group, an isoquinolinyl group, a thiazoline group, and a benzothiazolyl group. Preferred as $R_1$ are group represented by formula (I) which includes an aromatic group, a nitrogen-containing heterocycle, and group represented by formula (b) below.

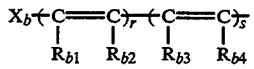

Formula (b)

wherein $X_b$ represents an aromatic group or a nitrogen-containing heterocycle group;

$R_{b1}$ to $R_{b4}$ each represents a hydrogen atom, a halogen atom, or an alkyl group;

$X_b$ and $R_{b1}$ to $R_{b4}$ may have a substituent; and r and s each represents 0 or 1.

An aromatic group is more preferred as $R_1$, and an aryl group is particularly preferred.

$R_1$ may be substituted with a substituent. The example of the substituent is represented by the following formula (c) which includes, for example, an alkyl group, an alkenyl group, an alkynyl group, an alkoxy group, an aryl group, a substituted amino group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxyl group, an alkyl- and aryloxycarbonyl group, an acyl group, an alkoxycarbonyl group, an acyloxy group, a carbonamide group, a sulfonamide group, a nitro group, an alkylthio group, and an arylthio group.

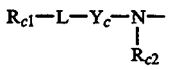

Formula (c)

wherein $Y_c$ represents —CO—, —$SO_2$—, —P(O)($R_3$)— (wherein $R_{c3}$ represents an alkoxy group or an aryloxy group), or —OP(O)($R_{c3}$)—;

L represents a single bond, —O—, —S—, or $NR_4$ (wherein $R_{c4}$ represents a hydrogen atom, an alkyl group, or an aryl group); and $R_{c1}$ and $R_{c2}$ each represents a hydrogen atom, an aliphatic group, an aromatic group, or a heterocycle and may be the same or different, or may be combined with each other to form a ring.

$R_1$ can contain one or more formulas (c) as a substituent.

In formula (c), the aliphatic group represented by $R_{c1}$ is a linear, branched or cyclic alkyl group, alkenyl group or alkynyl group. The aromatic group represented by $R_{c1}$ is a monocyclic or dicyclic aryl group which includes, for example, a phenyl group and a naphthyl group.

The hetero ring in $R_{c1}$ is a 3- to 10-membered saturated or unsaturated hetero ring containing at least one of N, 0 or S atom, which may form a single ring or a condensed ring with the other aromatic or hetero ring. The hetero ring. is preferably a 5- to 6-membered aromatic heterocyclic group, and preferred are those containing, for example, a pyridine group, an imidazolyl group, a quinolinyl group, a benzimidazolyl group, a pyrimidyl group, a pyrazolyl group, an isoquinolinyl group, a thiazolyl group, and a benzothiazolyl group.

$R_{c1}$ may be substituted with a substituent. For example, the following ones can be enumerated as the substituents, which may further be substituted. They are, for example, an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxyl group, an alkyl- and aryloxycarbonyl group, an acyl group, an alkoxycarbonyl group, an acyloxy group, a carbonamide group, a sulfonamide group, a nitro group, an alkylthio group, and an arylthio group. These groups may be combined with each other to form a ring.

The aliphatic group represented by $R_{c2}$ in formula (c) is a linear, branched or cyclic alkyl group, alkenyl group or alkynyl group. The aromatic group represented by $R_{c2}$ is a monocyclic or dicyclic aryl group, for example, a phenyl group, which may be substituted with a substituent. For example, those listed as the substituent for $R_{c1}$ in formula (c) can be enumerated as the substituents.

$R_{c1}$ and $R_{c2}$ may be combined with each other to form a ring.

A hydrogen atom is more preferred as $R_{c2}$.

Groups of —CO— and —$SO_2$— are particularly preferred as $Y_c$ in formula (c), and a single bond and —$NR_{c4}$— are preferred as L. The aliphatic group represented by $R_{c4}$ in formula (c) is a linear, branched or cyclic alkyl group, alkenyl group or alkynyl group. The aromatic group represented by $R_{c4}$ is a monocyclic or dicyclic aryl group, for example, a phenyl group.

$R_{c4}$ may be substituted with a substituent. For example, those listed as the substituent for $R_{c1}$ in formula (c) can be enumerated as the substituents. A hydrogen atom is more preferred as $R_{c4}$.

In the case where $G_1$ is a —C(O)— group, the preferred one of the groups represented by $R_2$ is a hydrogen atom, an alkyl group (for example, methyl, trifluoromethyl, 3-hydroxypropyl, 3-methanesulfonamidepropyl, n-propyl, methoxyethyl, methoxymethyl, phenoxymethyl, and phenylsulfonylmethyl), an aralkyl group (for example, o-hydroxybenzyl), and an aryl group (for example, phenyl, 3,5-dichlorophenyl, o-methanesulfonamidephenyl, 4-methanesulfonylphenyl, 4-cyanophenyl, 4-bromophenyl, 2,4-dichlorophenyl, and 2-hydoxymethylphenyl).

Also, $R_2$ may permit the portion of $G_1$–$R_2$ to split off from the residue of a molecule and may cause a cyclization reaction by which a cyclic structure containing the atoms in the portion of —$G_1$—$R_8$ is formed, and the compounds described in, for example, JP-A-63-29751 can be enumerated as the example thereof.

A hydrogen atom is the most preEerable as $A_1$ and $A_2$.

$R_1$ or $R_2$ in formula (I) may have a ballast group or polymer incorporated thereinto, which is conventionally used for an immobile photographic additive. The ballast group is a group which has a carbon number of 8 or more and is comparatively inactive to the photographic properties, and can be selected from, for example, an alkyl group, an alkoxy group, a phenyl group, an alkylphenyl group, a phenoxy group, and an alkylphenoxy group. Also, the compounds described in JP-A-1-100530 can be enumerated as the polymer.

$R_1$ or $R_2$ in formula (I) may be the group enhancing an adsorption to a surface of a silver halide grain, is incorporated. The example of the adsorbing group includes, for example, the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246, such as a thiourea group, a heterocyclic thioamide group, a mercapto heterocyclic group, and a triazole group. The particularly preferred aliphatic group, aromatic group or heterocyclic group for $R_1$, or the substituents therefor is that having an adsorption accelerating group to silver halide, containing a quaternary ammonium cation, or containing a partial structure of —O—$(CH_2CH_2O)_n$—, —O—$(CH_2CH(CH_3)O)_n$—, or —O—$(CH_2CH(OH)CH_2O)_n$— (n is an integer of 3 or more).

Example of the adsorption accelerating group includes, a thiourea group, a heterocyclic thioamide group, a mercapto heterocyclic group, a triazole group, and a group having a disulfide bond.

The hydrazine derivatives according to the present invention are preferably those represented by formulae (III) and (IV).

The hydrazine of formula (III) is explained in detail.

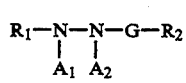

(III)

wherein $R_1$ represents aliphatic or aromatic groups which have a partial constituent of —O—$(CH_2CH_2O)_n$—, —O—$(CH_2CH(CH_3)O)_n$— or —O—$(CH_2CH(OH)CH_2O)_n$— (wherein n is an integer of 3 or more) as a part of the substituent, or contain quaternary ammonium cation; $G_1$ represents —CO—, —COCO—, —CS—, —C(=$NG_2R_2$)—, —SO—, —$SO_2$— or P(O)($G_2R_2$)— group (wherein $G_2$ is a mere connecting group, —O—, —S—, or —N($R_2$)— group); and $R_2$ represents aliphatic or aromatic group hydrogen atom, with proviso that when a plural $R_2$ is present in a molecule, these may be the same or different, and at least one of $A_1$ and $A_2$ is a hydrogen atom and rest of them is a hydrogen atom, an acyl group, an alkyl group or an arylsulfonyl group.

In more detail, the aliphatic group represented by $R_1$ in formula (III) is preferably those having 1 to 30 carbon atoms, more preferably, a straight, branched or cyclic alkyl group having 1 to 20 carbon atoms, which may be further substituted.

The aromatic group represented by $R_2$ in formula (III) is single or double cyclic aryl group or unsaturated heterocyclic group, wherein the unsaturated heterocyclic group may form heteroaryl group by condensing with an aryl group, such as benzene ring, naphthalene ring, pyridine ring, quinoline ring, and iso-quinoline ring. Of these groups, those having benzene ring are preferable, and more preferably an aryl group.

The aliphatic or aromatic group represented by $R_1$ is substituted. The representative substituents include, for example, an alkyl group, an aralkyl group, an alkenyl group, an alkinyl group, an alkoxy group, an aryl group, a substituted amino group, a ureide group; a urethane group, an aryloxy group, a sulfamoyl group, a hydroxyl group, a halogen atom, a cyano group, a sulfo group, an aryloxycarbonyl group, an acyl group, an alkoxycarbonyl group, an acyloxy group, a carbonamide group, a sulfonamide group, a carboxyl group, and phosphoric amide group.

Examples of preferable substituents include a straight, branched or cyclic alkyl group, preferably having 1 to 20 carbon atoms, an aralkyl group, preferably having 7 to 30 carbon atoms, an alkoxy group, preferably having 1 to 30 carbon atoms, a substituted amino group, preferably having 1 to 30 carbon atoms, an acylamino group, preferably having 2 to 40 carbon atoms, a sulfonamide group, preferably having 1 to 40 carbon atoms, a ureide group, preferably having 1 to 40 carbon atoms, and a phosphoric acid amide group, preferably having 1 to 40 carbon atoms.

The aliphatic or aromatic group, and substituents thereof represented by $R_1$ may contain $—O—(CH_2CH_2O)_n—$, $—O—(CH_2CH(CH_3)O)_n—$, $—O—(CH_2CH(OH)CH_2O)_n—$, or quaternary ammonium cation. In the above groups n represents an integer of 3 or more, and more preferably an integer of 3 to 15.

$R_1$ preferably represents in formulae ($E_1$), ($E_2$), ($E_3$) or ($E_4$) stated below.

(E1)

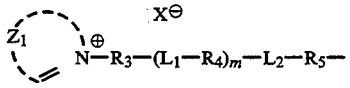

(E2)

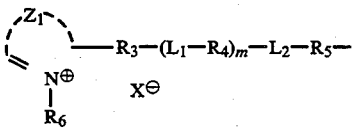

(E3)

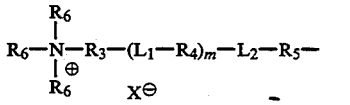

$$R_6—O—(L_3)_n—R_3—(L_1—R_4)_m—L_2—R_5— \quad (E4)$$

In the formulae, $L_1$ and $L_2$ each represents $—CONR_7—$, $—NR_7COR_8—$, $—SO_2NR_7—$ or $—NR_7SO_3NR_6—$, which may be the same or different. $R_7$ and $R_8$ each represents a hydrogen atom, an alkyl group having 1 to 6 carbon atoms, an aryl group having 6 to 10 carbon atoms, and m is 0 or 1.

$R_3$, $R_4$ and $R_5$ each represents a two valent aliphatic or aromatic group, preferably an alkyl group, an arylene group or two valent group formed by combining with —O—, —CO—, —S—, —SO—, $—SO_2—$, or $—NR_9—$ group, wherein $R_9$ is the same meaning as $R_7$ in formulae (II), (III) and (IV). More preferably, $R_3$ represents an alkylene group having 1 to 10 carbon atoms or two valent group formed by combining with —S—, —SO— or $—SO_2—$ group. $R_4$ and $R_5$ each represents an arylene group having 6 to 20 carbon atoms. Particularly preferably, $R_5$ represents a phenylene group.

$R_3$, $R_4$ and $R_5$ may be substituted with substituents, preferably which are stated as the substituents for $R_1$.

In formulae ($E_1$) and ($E_2$), $Z_1$ represents an atomic group which is necessary to form nitrogen containing aromatic group. Example of the preferable nitrogen containing aromatic group formed by Z and nitrogen atom includes a pyridine ring, pyrimidine ring, pyridazine ring, a pyrazine ring, an imidazole ring, a pyrazole ring, a pyrrole ring, an oxazole ring and thiazole ring, and a benzo-condensed ring thereof, a pteridine ring and a naphthyridine ring.

In formulae (E2), (E3) and (E4), $X^{\ominus}$ represents a pair anion or pair anion moiety when an inner-molecule salt is formed.

In formula (E2), (E3) and (E4), $R_6$ represents an aliphatic or aromatic group, and preferably an alkyl group having 1 to 20 carbon atoms or an aryl group having 6 to 20 carbon atoms.

Three $R_6$s in formula (E3) each may be the same or different or may form a ring by connecting each other. $Z_1$ and $R_6$ may be substituted by substituents which are preferably the same group stated as the substituents for $R_1$.

In formula (E4), $L_3$ represents $—CH_2CH_2O—$, $—CH_2CH(CH_3)O—$ or $—CH_2CH(OH)CH_2O—$ group, and n is the same as stated in formula (E1).

In formula (III), $G_1$ represents preferably —CO— or $—SO_2—$ group, and more preferably —CO— group. $A_1$ and $A_2$ each represents preferably a hydrogen atom.

In formula (III), the alkyl group represented by $R_2$ is preferably an alkyl group having 1 to 4 carbon atoms and the aryl group of $R_2$ is preferably an aryl group of single or two ring, for example, those having a benzene ring.

When $G_1$ represents —CO— group, the preferable groups represented by $R_2$ include a hydrogen atom; an alkyl group such as methyl, methoxymethyl, phenoxymethyl, trifluoromethyl, 3-hydroxypropyl, 3-methanesulfonamidopropyl, and phenylsulfonylmethyl group; an aralkyl group, such as o-hydroxybenzyl; an aryl group, such as phenyl, 3,5-dichlorophenyl, o-methanesulfonamidophenyl, 4-methanesulfonylphenyl, and 2-hydroxymethylphenyl, and particularly preferably a hydrogen atom.

$R_2$ may be substituted by substituents, in which the substituent stated as those for $R_1$ may be used. Further, $R_2$ may be a group which splits $G_1$–$R_2$ R moiety from the residual molecule to create cyclizing reaction, an example of which represents those disclosed in, for example, JP-A-63-29751.

$R_1$ or $R_2$ in formula (III) may be a coupler, in which a conventional ballast group or polymer in immobilized photographic additives may be incorporated. The ballast group is relatively inactive group for photographic properties having 8 or more carbon atom, which may be adopted from the groups, such as an alkyl group, an alkoxy group, a phenyl group, an alkylphenyl group, a phenoxy group, and an alkylphenoxy group. Example of the polymers may be those disclosed in JP-A-1-100530.

$R_1$ or $R_2$ in formula (III) may be a group, in which a group enhancing absorption onto a silver halide grain surface may be incorporated. Example of such absorption group includes a thiourea, a heterocyclic thioamide, a mercapto-heterocyclic group and triazole group, which are disclosed in U.S. Pat. Nos. 4,385,108 and 4,459,347, JP-A-59-195233, JP-A-59-200231, JP-A--59-201045, JP-A-59-201046, JP-A-59-201047, JP-A-59-

201048, JP-A-59-201-49, JP-A-61-170733, JP-A-61-270744, JP-A-62-948, JP-A-63-234244, JP-A-63-234245 and JP-A-63-234246.
The compound of formula (III) according to the present invention may be synthesized by the method disclosed in, for example, JP-A-61-213847, JP-A-62-260153, JP-A-49-129536, JP-A-56-153336, JP-A-56-153342, U.S. Pat. Nos. 4,684,604, 3,379,529, 3,620,746, 4,377,634, 4,332,878, 4,988,604 and 4,994,365, and 549Japanese Patent Application 63-803.
Examples of the compounds which may be used in the present invention are illustrated as follows, without restricting thereof.
H-1
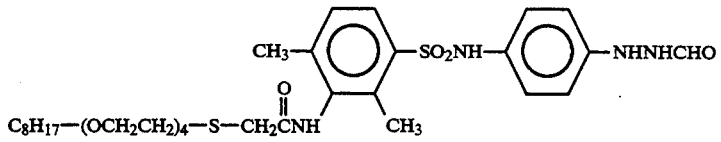
H-2
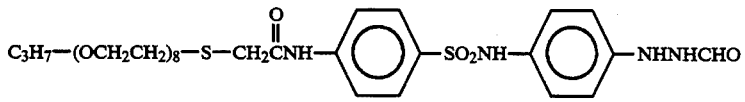
H-3
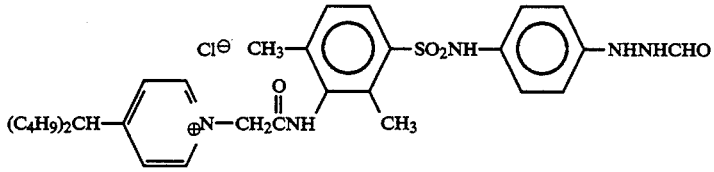
H-4
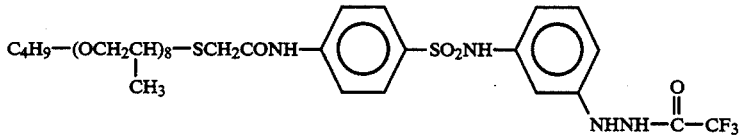
H-5
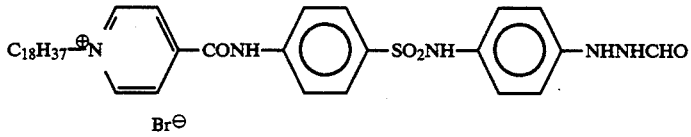
H-6
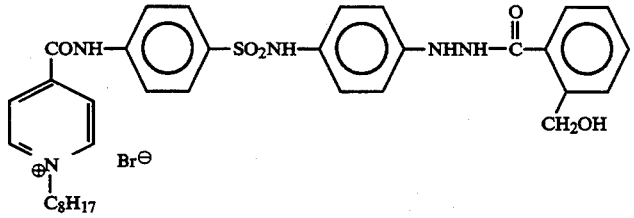
H-7
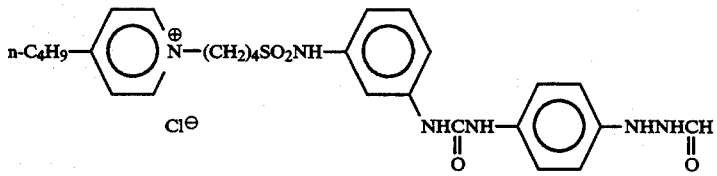
H-8
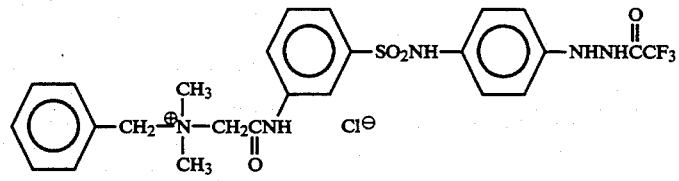

-continued

H-9

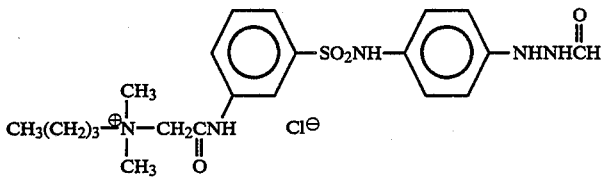

H-10

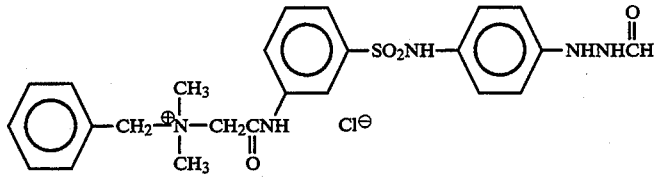

The compounds represented by formula (IV) are described in more detail hereinunder.

$$R_1—NHNH—G—R_2 \quad \text{(IV)}$$

wherein $R_1$ represents aliphatic, aromatic or heterocyclic group, which may be substituted; G represents —CO—, —$SO_2$—, —SO—, —COCO—, thiocarbonyl, iminomethylene group or —P(O)($R_3$)—group; and $R_2$ represents a substituted alkyl group, in which a carbon atom substituted by group G is further substituted with at least one electron withdrawing group; and $R_3$ represents a hydrogen atom, aliphatic group, aromatic group, an alkoxy group, an aryloxy group or an amino group.

The compounds represented by formula (IV) are disclosed in more detail herein below.

The aliphatic group represented by $R_1$ in formula (IV) is straight, branched or cyclic alkyl, alkenyl or alkinyl group.

The aromatic group represented by $R_1$ is single or double ring aryl group, such as a phenyl group and a naphthyl group.

The heterocyclic ring represented by $R_1$ is a 3- to 10-membered saturated or unsaturated hetero ring which contains at least one of N, O and S atom, which may be single ring, and may be combined with other aromatic group or hetero ring to form a condensed ring. Preferable example of the heterocyclic ring is those containing 5- or 6-membered aromatic heterocyclic group, for example, a-pyrimidine group, an imidazolyl group, a quinolinyl group, a benzimidazolyl group, a pyrimidyl group, a pyrazolyl group, an isoquinolinyl group, a thiazoline group, a benzthiazoline group or a benzothiazolyl group.

Preferable group represented by $R_1$ is aromatic, nitrogen containing heterocyclic group and a group of formula (b).

$$X_b\text{-}(C(R_{b1})=C(R_{b2}))_r\text{-}(C(R_{b3})=C(R_{b4}))_s \quad \text{(b)}$$

wherein $X_b$ represents an aromatic or nitrogen containing heterocyclic group, $R_{b1}$ to $R_{b4}$ each represents a hydrogen atom, a halogen atom, or an alkyl group; $X_b$ and $R_{b1}$ to $R_{b4}$ may be substituted if available; and r and s each is 0 or 1.

$R_1$ is preferably an aromatic group and more preferably an aryl group.

$R_1$ may also be substituted with substituent, which is, for example, an alkyl group, an aralkyl group, an alkenyl group, an alkinyl group, an alkoxy group, an aryl group, a substituted amino group, an aryloxy group, a sulfamoyl group, a carbamoyl group, an alkylthio group, an arylthio group, a sulfonyl group, a sulfinyl group, a hydroxy group, a halogen atom, a cyano group, an alkoxy carbonyl group, an acyloxy group, a carbonamido group, a sulfonamido group, a nitro group, an alkylthio group, an arylthio group, and a group represented by formula (c), as well.

$$R_{c1}—L—Y_c—\underset{\underset{R_{c2}}{\|}}{N}— \quad \text{(c)}$$

wherein $Y_c$ represents —CO—, —$SO_2$—, —P(O)($R_{c3}$)— or —OP(O)($R_{c3}$)— (in which $R_{c3}$ represents an alkoxy group, or an aryloxy group); L represents single bond, —O—, —S— or —$NR_{c4}$— (in which $R_{c4}$ represents a hydrogen atom, an alkyl group, or an aryl group); and $R_{c1}$ and and $R_{c2}$, which may be the same or different, each represents a hydrogen atom, aliphatic, aromatic, or heterocyclic group. $R_{c1}$ may contain one or more group of formula (c).

In formula (c), the aliphatic group represented by $R_{c1}$ is straight, branched or cyclic alkyl group, alkenyl group or alkinyl group.

The aromatic group represented by $R_{c1}$ is a single or double ring aryl group, for example, a phenyl group and a naphthyl group.

The heterocyclic ring represented by $R_{c1}$ is 3- to 10-membered saturated or unsaturated hetero-ring in which at least one N, 0 or S atom is contained. Said ring may be a single ring or may form a condensed ring with other aromatic or hereto ring. Example of the hetero ring is preferably 5- or 6-membered aromatic heterocyclic group, which contains, such as, a pyridine group, an imidazolyl group, a quinolinyl group, a benzimidazolyl group, a pyrimidyl group, a pyrazolyl group, an isoquinolinyl group, a thiazolyl group and a benzthiazolyl group.

$R_{c1}$ may be substituted with substituents which represent following groups, which may further be substituted with groups such as an alkyl group, an aralkyl group, an alkenyl group, an alkinyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxyl group, an alkyl- or aryloxycarbonyl group, an acyl group, an alkoxycarbonyl group, an acyloxy group, a carbonamido group, a sulfonamido group, a nitro group, an alkylthio group and an arylthio group. These groups may be combined each other to form a ring if available.

In formula (c), the aliphatic group represented by $R_{c2}$ is a straight, branched or cyclic alkyl, alkenyl or alkinyl group.

The aromatic group represented by $R_2$ is a single or double ring aryl group, such as a phenyl group.

$R_{c4}$ may be substituted with the substituents which are, for example, groups stated as the substituents for $R_{c1}$.

In formula (IV), G is —CO— most preferably.

$R_2$ in formula (IV) represents a substituted alkyl group in which the carbon atom of G is substituted with at least one electron withdrawing group, preferably two and particularly preferably three electron withdrawing goups.

The electron withdrawing group which substitutes the substituted carbon atom with G in $R_2$ is preferably groups having p value of 0.2 or more, or 0.3 or more, for example, a halogen atom, a cyano group, a nitro group, a nitroso group, a polyhaloalkyl group, a polyhaloaryl group, an alkyl- or arylcarbonyl group, a formyl group, an alkyl- or aryloxycarbonyl group, an alkylcarbonyloxy group, a carbamoyl group, an alkyl- or arylsulfinyl group, an alkyl- or arylsulfonyl group, an alkyl- or arylsulfonyloxy group, a sulfamoyl group, a phosphino group, a phosphinoxide group, a phosphonic acid ester group, a phosphonic acid amide group, an arylazo group, an amidino group, an ammonio group, a sulfonyl group, and an electron-deficient heterocyclic group.

$R_2$ in formula (IV) is particularly preferably trifluoromethyl group.

$R_1$ and $R_2$ in formula (IV) may be a ballast group or polymer which is conventionally used in an immobile photographic additive such as coupler. The ballast group is a relatively inert group having 8 or more carbon atoms with respect to photographic properties, which may be selected from, for example, an alkyl group, an alkoxy group, a phenyl group, an alkylphenyl group, a phenoxy group, an alkylphenoxy group. The polymer is disclosed in JP-A-1-100530.

$R_1$ and $R_2$ in formula (IV) may incorporate a group enhancing absorbability for silver halide grain surface. Said absorbent includes a thiourea group, a heterocyclic thioamido group, a mercapto heterocyclic group, and a triazole group, which are disclosed in U.S. Pat. Nos. 4,385,108, 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246.

The compounds used in the present invention are illustrated as follow without restriction thereof.

H-11

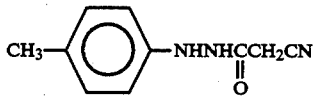

H-12

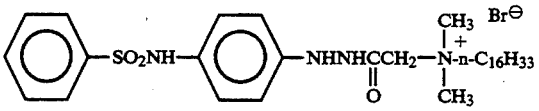

H-13

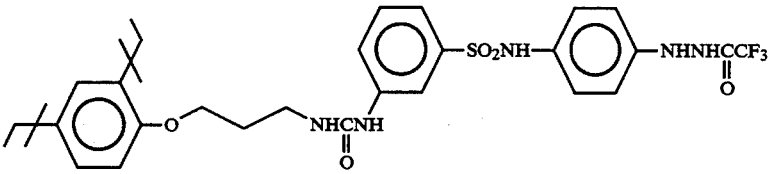

H-14

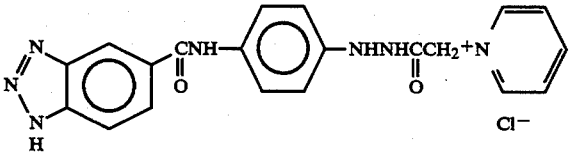

H-15

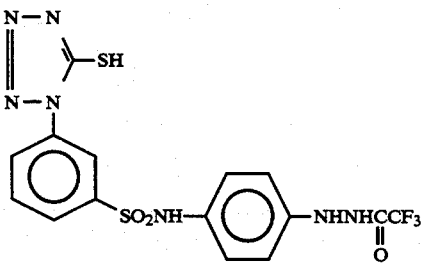

-continued

H-16

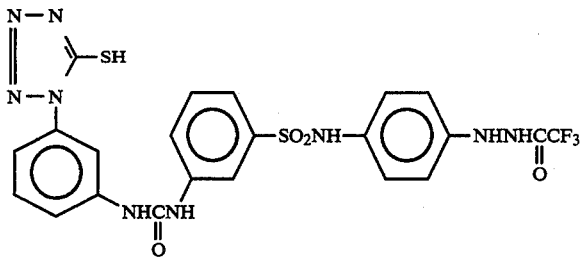

H-17

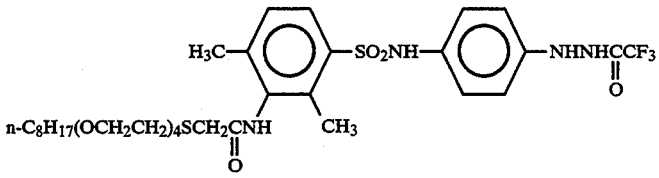

H-18

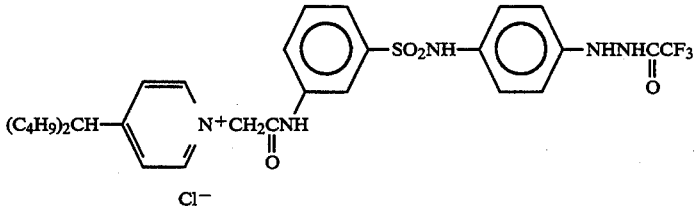

H-19

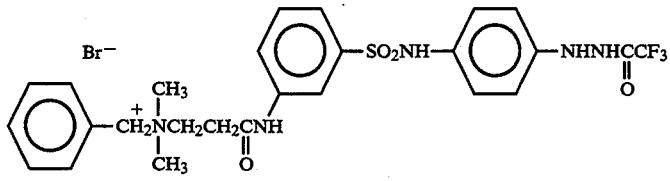

H-20

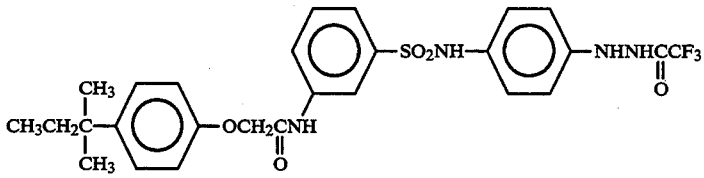

In addition to the compounds described above, there can be used as the hydrazine derivative used in the present invention, the compounds described in Research Disclosure Item 23516 (November 1983, pp. 346) and the publications cited therein, and in addition, U.S. Pat. Nos. 4,080,207, 4,269,929, 4,276,364, 4,278,748, 4,385,108, 4,459,347, 4,560,638, and 4,478,928, British Patent 2,011,391B, JP-A-60-179734, JP-A-62-270948, JP-A-63-29751, JP-A-61-170733, JP-A-61-270744, and JP-A-62-270948, EP 217,310, EP 356,898, U.S. Pat. No. 4,686,167, and JP-A-62-178246, JP-A-63-32538, JP-A-63-104047, JP-A-63-121838, JP-A-63-129337, JP-A-63-223744,JP-A-63-234244, JP-A-63-234245, JP-A-63-234246, JP-A-63-294552, JP-A-63-306438, JP-A-1-100530, JP-A-1-105941, JP-A-1-105943, JP-A-64-10233, JP-A-1-90439, JP-A-1-276128, JP-A-1-280747, JP-A-1-283548, JP-A-1-283549, JP-A-1-285940, JP-A-63-147339, JP-A-63-179760, JP-A-63-229163, JP-A-2-198440, JP-A-2-198441, JP-A-2-198442, JP-A-2-196234, JP-A-2-196235, JP-A-2-220042, JP-A-2-221953, JP-A-2-221954, JP-A-2-302750, and JP-A-2-304550.

The addition amount of the hydrazine derivative in the present invention is preferably $1\times10^{-6}$ to $5\times10^{-2}$ mole per mole of silver halide, and in particular, a preferred addition amount falls within the range of $1\times10^{-5}$ to $2\times10^{-2}$ mole per mole of silver halide.

The hydrazine derivatives used in the present invention can be dissolved in a suitable solvent, for example, alcohols (methanol, ethanol, propanol, and fluorinted alcohol), ketones (acetone and methyl ethyl ketones), dimethylformamide, dimethylsulfoxide, and methyl cellosolve.

Further, the hydrazine derivatives can be dissolved with the aid of an oil such as dibutyl phthalate, tricresyl phosphate, glyceryl triacetate, and diethyl phthalate, and an auxiliary solvent such as ethyl acetate and cyclohexanone to mechanically prepare the emulsified dispersions thereof by the well known dispersing methods as well. Alternatively, the powders of the hydrazine derivatives can be dispersed in water by the method known as a solid matter dispersing method with a ball mill, a colloid mill or a supersonic wave as well.

Next, formula (II) will be explained.

In the formula (II), $R_{21}$ and $R_{22}$ each represent a hydroxy group, an amino group, an acylamino group, an alkylsulfonylamino group, an arylsulfonylamino group, an alkoxycarbonylamino group, a mercapto group, or an alkylthio group, and X represents an atomic group necessary to form a 5- to 6-membered ring together with two vinyl carbon atoms substituted with $R_1$ and $R_2$ and a carbonyl carbon atom.

In more detail in the formula (II), $R_{21}$ and $R_{22}$ each represents a hydroxy group, an amino group (including those having an alkyl group with a carbon number of 1 to 10, for example, methyl, ethyl, n-butyl, and hydroxyethyl as a substituent), an acylamino group (acetylamino, benzoylamino, etc.), an alkylsulfonylamino group (methanesulfonylamino, etc.), an arylsulfonylamino group (benzenesulfonylamino, p-toluene-sulfonylamino, etc.), an alkoxycarbonylamino group (methoxycarbonylamino, etc.), a mercapto group, or an alkylthio group (methylthio, ethylthio, etc.). A hydroxy group, an amino group, an alkylsulfonylamino group, and an arylsulfonylamino group can be enumerated as the preferred examples for $R_2$and $R_{22}$.

X is composed of a carbon atom, an oxygen atom or a nitrogen atom and constitutes a 5- to 6-membered ring together with two vinyl carbon atoms substituted with $R_{21}$ and $R_{22}$ and a carbonyl carbon atom. The concrete example of X is constituted in combination of —O—, —C—($R_{23}$)($R_{24}$)—, —C($R_{25}$)=, —C(=O)—, —N($R_{26}$)—, and —N=, provided that $R_{23}$, $R_{24}$, $R_{25}$, and $R_{26}$ each represents a hydrogen atom, an alkyl group which has carbon number of 1 to 10 and may be substituted (a hydroxy group, a carboxy group and a sulfo group can be enumerated as the substituent), an aryl group which has a carbon number of 6 to 15 and may be substituted (an alkyl group, a halogen atom, a hydroxy group, a carboxy group and a sulfo group can be enumerated as the substituent), a hydroxy group, or a carboxyl group. Further, a saturated or unsaturated condensed ring may forme on said 5- to 6-membered ring.

The examples of 5- to 6-membered ring include, a dihydrofuranone ring, a dihydropyrone ring, a pyranone ring, a cyclopentenone ring, a cyclohexenone ring, a pyrrolinone ring, a pyrazolinone ring, a pyridone ring, an azacyclohexenone ring, and a uracil ring. Example of the preferred 5- to 6-membered ring include, a dihydrofuranone ring, a cyclopentenone ring, a cyclohexenone ring, a pyrazolinone ring, an azacyclohexenone ring, and a uracil ring.

The specific examples of the compound according to the present invention will be shown below but the present invention will not be limited thereto.

II-1

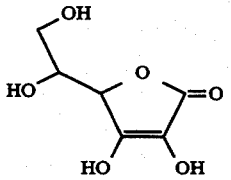

II-2

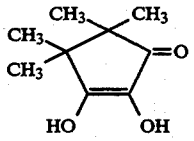

-continued

II-3

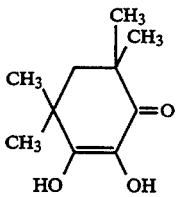

II-4

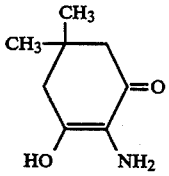

II-5

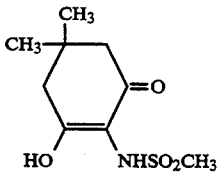

II-6

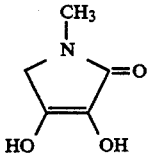

II-7

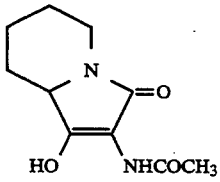

II-8

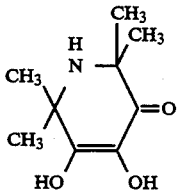

II-9

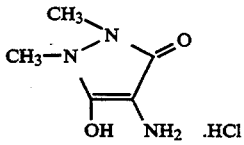

II-10

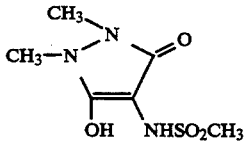

II-11

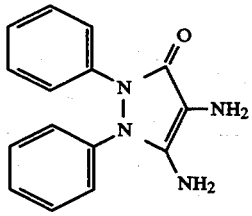

-continued

II-12

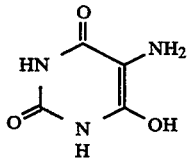

II-13

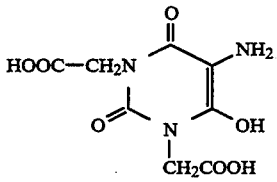

II-14

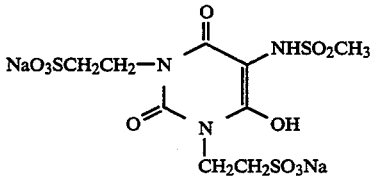

II-15

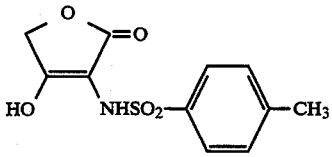

II-16

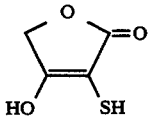

II-17

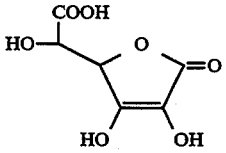

II-18

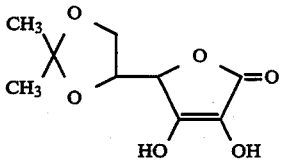

II-19

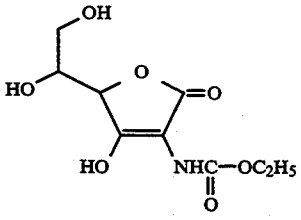

II-20

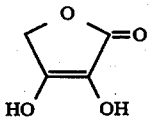

-continued

II-21

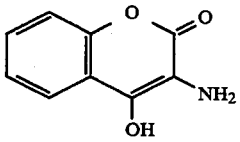

II-22

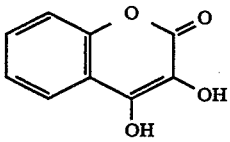

Of the above compounds, preferred is ascorbic acid or erysorbic acid (stereoisomer) (II-1). A concentration ratio of the compound represented by formula (II)/a hydroquinone developing agent (a value obtained by dividing a concentration of the compound represented by formula (II) by that of the hydroquinone developing agent) falls within the range of 0.03 to 0.12. The preferred concentration ratio is 0.03 to 0.10 and the particularly preferred concentration ratio is 0.05 to 0.09.

When the ratio obtained by dividing the concentration of the compound (II) by that of the dihydroxy-benzene developing agent becomes 0.12 or higher, a variety of the photographic properties in terms of sensitivity, gradation and lowering Dm, becomes larger resulting from an air-oxidation of the compound (II) due to lowering pH in the developing solution.

On the contrary, when the ratio becomes 0.03 or smaller, pH of the dihydroxybenzene developing agent becomes higher due to an oxidation of the dihydroxybenzene developing agent thereby steep increasing the black spots.

Preferred as the hydroquinone developing agent used in the present invention, are hydroquinone, chlorohydroquinone, bromohydroquinone, isopropylhydroquinone, methylhydroquinone, 2,3-dibromohydroquinone, and 2,5-dimethylhydroquinone. Hydroquinone is particularly preferred. A concentration of the hydroquinone derivative in a developing solution is 0.2 to 0.75 mole/liter, preferably 0.2 to 0.5 mole/liter, and particularly preferably 0.2 to 0.4 mole/liter.

The 1-phenyl-3-pyrazolidone developing agent used in the present invention includes 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3pyrazolidone, 1-phenyl-5-methyl-3-pyrazolidone, 1-p-amino-phenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone. It is preferably 1-phenyl-3-pyrazolidone and 1-phenyl-4-methyl-4-hydroxymethyl-3-pyrazolidone.

The p-aminophenol developing agent used in the present invention includes N-methyl-p-aminophenol, p-aminophenol, N-(b-hydroxyethyl)-p-aminophenol, and N-(4-hydroxyphenyl)glycine. Among them, N-methyl-p-aminophenol is preferred.

In the case where the combination of dihydroxybenzenes and 1-phenyl-3-pyrazolidones or p-aminophenols is used, the former, dihydroxybenzene, is used preferably in an amount of 0.05 to 0.5 mol/liter and the latter, phenylpyrazolidone or aminophenol, in an amount of 0.06 mol/liter or less.

A preservative used for a developing solution for a development processing according to the present invention is a free sulfite ion and a form in adding to the developing solution includes sodium sulfite, lithium sulfite, ammonium sulfite, and sodium bisulfite. A concentration of the free sulfurous acid ion is 0.3 to 1.2 mole/liter, preferably 0.4 to 1.0 mole/liter, and particularly preferably 0.5 to 0.8 mole/liter.

pH of the developing solution used for a development processing in the present invention falls within the range of 9.0 to 11.0, preferably 9.5 to 10.8. An alkali agent used for setting pH includes a pH controller such as sodium hydroxide, sodium carbonate, sodium tertiary phosphate, potassium hydroxide, and potassium carbonate.

Since a boric acid salt used as a buffer agent usually forms a complex with the ascorbic acid derivative compound of formula (II), it is preferably not present in a developing solution.

A dialdehyde hardener or the bisulfite adduct thereof is sometimes used in a developing solution used in the process according to the present invention. The specific examples thereof include glutaraldehyde, α-methylglutaraldehyde, β-methylglutaraldehyde, maleindialdehyde, succindialdehyde, methoxysuccindialdehyde, methylsuccindialdehyde, α-methoxy-β-ethoxyglutaraldehyde, α-n-butoxyglutaraldehyde, α,α-diethylsuccindialdehyde, butylmaleindialdehyde, or the bisulfite adduct thereof. Of them, glutaraldehyde or the bisulfite adduct thereof are most generally used. The dialdehyde compound is used in such an amount that a sensitivity of a photographic layer is not suppressed and a drying time also is not markedly extended. To be concrete, it is 1 to 50 g, preferably 3 to 10 g per liter of a developing solution.

An anti-fogging agent is used in a developing solution used in the process according to the present invention, which includes, for example, an indazole, a benzimidazole, or a benzotriazole. To be concrete, there can be enumerated 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazole-2yl)thio]butanesulfonate, and 5-amino-1,3,4-thiadiazole-2-thiol. An amount of these anti-fogging agents is usually 0.01 to 10 mmol, more preferably 0.1 to 2 mmol per liter of a developing solution. In addition to these organic anti-fogging agents, halide such as, potassium bromide and sodium bromide, can be used as well.

Further, various organic and inorganic chelating agents can be used in combination in a developing solution according to the present invention. Sodium tetrapolyphosphate and sodium hexametaphosphate can be used as the inorganic chelating agent.

On the other hand, there can be used as the organic chelating agent, mainly organic carboxylic acid, aminopolycarboxylic acid, organic phosphonic acid, aminophosphoniCacid, and organic phosphonocarboxylic acid.

Example of the organic carboxylic acid includes, acrylic acid, oxalic acid, malonic acid, succinic acid, glutaric acid, adipic acid, pimelic acid, cork acid, sebatic acid, nonanedicarboxylic acid, decanedicarboxylic acid, undecanedicarboxylic acid, maleic acid, itaconic acid, maric acid, citric acid, and tartaric acid, but it will not be limited thereto.

Example of the aminopolycarboxylic acid includes, iminodiacetic acid, nitrilotriacetic acid, nitrilotripropionic acid, ethylenediaminomonohydroxyethyltriacetic acid, ethylenediaminetetraacetic acid, glycoletheretetraacetic acid, 1,2-diaminopropanetetraacetic acid, diethylenetriaminepentaacetic acid, triethylenetetraminehexaacetic acid, 1,3-diamino-2propanoltetraacetic acid, glycoletherdiaminotetraacetic acid, and in addition thereto, the compounds described in JP-A-52-25632, JP-A-55-67747, and JP-A-57-102624, and JP-B-53-40900 (the term "JP-B" as used herein means an examined Japanese patent publication).

Example of organic phosphonic acid includes, hydroxyalkylidenendiphosphonic acid described in U.S. Pat. Nos. 3,214,454 and 3,794,591, and German Patent Publication 2,227,639, and the compounds described in Research Disclosure vol. 181, Item 18170 (May 1979).

Example of aminophosphonic acid includes, aminotris(methylenephosphonic acid), ethylenediaminotetramethylenephosphonic acid, and aminotrimethylenephosphonic acid. In addition thereto, there can be enumerated the compounds described in above Research Disclosure Item 18170, and JP-A-57-208554, JP-A-54-61125, JP-A-55-29883, and JP-A-56-97347.

Example of organic phosphonocarboxylic acid includes, the compounds described in JP-A-52-102726, JP-A-53-42730, JP-A-54-121127, JP-A-55-4024, JP-A-55-4025, JP-A-55-12641, JP-A-55-65955, and JP-A-55-65956, and above Research Disclosure Item 18170.

These chelating agents may be used in the forms of an alkali metal salt and an ammonium salt. An addition amount of these chelating agents is preferably $1\times10^{-4}$ to $1\times10^{-1}$ mole, more preferably $1\times10^{-3}$ to $1\times10^{-2}$ mole per liter of a developing solution.

In addition to the components described above, there can be incorporated into the developing solution used in the process of the present invention according to necessity, a buffer agent (for example, carbonate and alkanolamine), an alkali agent (for example, hydroxide and carbonate), a dissolution aid (for example, polyethylene glycols and esters thereof), a pH controlling agent (for example, organic acid such as acetic acid), a development accelerator (for example, various pyridinium compounds and the other cationic compounds described in U.S. Pat. No. 2,648,604, JP-B-44-9503, and U.S. Pat. No. 3,171,247, a cationic dye such as phenosafuranine, a neutral salt such as thallium nitrate and potassium nitrate, polyethyleneglycols and the derivatives thereof described in JP-B-44-9304, and U.S. Pat. Nos. 2,533,990, 2,531,832, 2,950,970, and 2,577,127, a nonionic compound such as polythioethers, the organic solvents described in JP-B-44-9509 and Belgian Patent 682,862, and the thioether compounds described in U.S. Pat. No. 3,201,242 (the thioether compounds are particularly preferred), and a surface active agent.

Development processing temperature and time are related to each other and determined in relation to the whole processing time. In general, the processing temperature is about 20 to about 50° C. and the processing time is 10 seconds to 2 minutes.

In processing 1 square meter of a silver halide black-and-white photographic material, a replenishing amount for a developing solution is 700 ml or less, preferably 500 ml or less.

A fixing process is carried out in succession after a developing process. A fixing solution used in the fixing process according to the present invention is a solution containing sodium thiosulfate and ammonium thiosulfate, and according to necessity, tartaric acid, citric acid, gluconic acid, boric acid, and the salts thereof. Usually, pH is about 3.8 to about 7.0, preferably 5.0 to 7.0, and particularly preferably 5.2 to 6.0. Of these components, a fixing agent is sodium thiosulfate or ammonium thiosulfate. A use amount of thiosulfate is 0.5 to 2.0 mole/liter, preferably 0.7 to 1.6 mole/liter, and particularly preferably 1.0 to 1.5 mole/liter.

The fixing solution may contain a hardener (for example, a water soluble aluminum compound), a preservative (for example, sulfite and bisulfite), a pH buffer agent (for example, acetic acid and boric acid), a pH controller (for example, ammonia and sulfuric acid), a chelating agent, a surface active agent, a humidifier, and a fixing accelerator, if desired. Example of the surface active agent includes, for example, an anionic surface active agent such as sulfate and sulfonate, a polyethylene series surface active agent, and the amphoteric surface active agents described in JP-A-57-6840. Also, the publicly known defoaming agents may be added. Example of the humidifier include, for example, alkanolamine and alkyl glycol. Example of the fixing accelerator incudes, for example, the thiourea derivatives described in JP-B-45-35754, JP-B-58-122535 and JP-B-58-122536, alcohol having a triple bond in a molecule, the thioether compounds described in U.S. Pat. No. 4,126,459, and the mesoionic compounds described in JP-A-4-229860. As the pH buffer agent, for example, organic acid such as acetic acid, malic acid, succinic acid, tartaric acid, and citric acid, and an inorganic buffer agent such as boric acid, phosphate and sulfite, may be used. The inorganic buffer agents are preferably used from the viewpoint of odor and the prevention of rust generation on an equipment material. The pH buffer agent is used for the purpose of preventing pH increase due to a developing solution carried over. It is used in an amount of not much more than 0.1 to 1.0 mole/liter, more preferably 0.2 to 0.6 mole/liter.

The hardener used in the fixing solution according to the present invention includes a water soluble aluminum salt and chromium salt. The preferred compound is the water soluble aluminum salt and includes, for example, aluminum chloride, aluminum sulfate, and potassium alum. A fixing temperature and time are about 20 to about 50° C. and 5 seconds to 1 minute, respectively. A replenishing amount of the fixing solution is 700 ml/m$^2$ or less, particularly preferably 500 ml/m$^2$ or less. A light-sensitive material finishing the developing and fixing processings is then subjected to a washing or stabilization processing. The washing or stabilization. processing can be carried out in a replenishing amount of 3 liter or less (including 0, that is, washing with stagnant water) per m$^2$ of a silver halide light-sensitive material. That is, not only a water-saving processing makes possible but piping for installing an automatic developing machine can become unnecessary. In the case where washing is carried out with a small amount of water, there is more preferably provided a sewage purifier with a squeeze roller, described in JP-A-63-18350 and JP-A-62-287252. Further, for the reduction of load of a public pollution which is a problem in washing with a small amount of water, addition of various oxidizing agents and filtration with a filter may be combined. Further, a part or all of an overflowed solution from a washing or stabilizing bath, which generates by replenishing water subjected to an anti-fungus treatment to the washing or stabilizing bath according to a processing in the process of the present invention, can be utilized as well for a processing solution having a fixing ability which is the preceding processing process thereof, as described in JP-A-60-235133. For preventing water spots and/or transfer of a processing agent component adhered to .a squeeze roller on a processed film, which are liable to generate in washing with a small amount of water, a water soluble surface active agent and a defoaming agent may be added. Further, a dye-adsorbing agent described in JP-A-63-163456 may be incorporated into a washing bath for preventing.contamination by a dye eluted from a light-sensitive material.

A stabilization process is sometimes carried out following the washing processing described above. For example, there may be applied as a final bath, which contains the compounds described in JP-A-2-201357, JP-A-2-132435, JP-A-1-102553, and JP-A-46-44446. There are preferably used as well for this stabilizing bath according to necessity, an ammonium compound, metal compounds of Bi and Al, a fluorescent whitening agent, various chelating agents, a film pH controller, a hardener, a fungicide, an anti-mold agent, and deionized water and water sterilized with a UV bacteriacidal lamp and various oxidizing agents (ozone, hydrogen peroxide, and chlorate) in addition to city water for water used for alkanolamine and a surface active agent.

No limitation is put on the halogen composition of the silver halide emulsion used in the present invention. Silver chloride content is 60 mole % or more and the composition comprises preferably any of silver bromochloride, silver chloroiodide, and silver bromochloroiodide. Particularly preferably, a silver iodide content thereof is 3 mole % or less, more preferably 0.5 mole % or less.

Various processes well known in the field of a silver halide photographic material can be used for the process for preparing the silver halide emulsion used in the present invention. It can be prepared by the processes described in, for example, "Chimie et Physique Photographique" written by P. Glafkides (published by Paul Montel Co., 1967), "Photographic Emulsion Chemistry" written by G.F. Duffin (published by The Focal Press Co., 1966), and "Making and Coating Photographic Emulsion" written by V.L. Zelikman et al (published by The Focal Press Co., 1964).

The emulsion according to the present invention is preferably a monodispersed emulsion and has the fluctuation coefficient of 20% or less, particularly preferably 15% or less.

The grains contained in the monodispersed silver halide emulsion has the average grain size of 0.5 μm or less, particularly preferably 0.1 to 0.4 μm.

Any of a single jet process, a double jet process and the combination thereof may be used as the process for reacting a water soluble silver salt (a silver nitrate aqueous solution) with a water soluble halide. There can be used as one type of the double jet process, a process where a pAg in the solution, for which the silver halide is formed, is maintained constant. That is, a controlled double jet process is used. A so-called silver halide solvent, such as, ammonia, thioether, and tetra-substituted thiourea, is preferably used to form a grain.

A tetra-substituted thiourea compound is more preferred and is described in JP-A-53-82408 and JP-A-55-77737. More preferred thiourea compound is tetramethyl thiourea or 1,3-dimethyl-2-imidazolidinethione.

A silver halide emulsion having a regular crystal form and a narrow grain size distribution can readily be prepared by the controlled double jet process and a grain forming process in which a silver halide solvent is used, and they are the useful means for preparing the emulsion used in the present invention.

A monodispersed emulsion has preferably a regular crystal form such as, cube, octahedron and tetradecahedron. In particular, cube is preferred. The silver halide grains may consist of either a phase in which the inside and surface thereof are even or a phase in which they are different.

A cadmium salt, a sulfite salt, a lead salt, a thallium salt, a rhodium salt or the complex salt thereof, and an iridium salt or the complex salt thereof may be allowed to coexist with the silver halide emulsion used in the present invention in the processes of a formation or a physical ripening of the silver halide grains.

In the present invention, the silver halide emulsion particularly suitable for the light-sensitive materials for photographing a line drawing and preparing a halftone dot is an emulsion prepared in the presence of the iridium salt or complex salt thereof in an amount of $10^{-8}$ to $10^{-5}$ mole per mole of silver. In the above case, the above amount of the iridium salt is preferably added before the completion of a physical ripening in a manufacturing process of a silver halide emulsion, particularly in a grain formation.

The iridium salt used herein is a water soluble iridium salt or an iridium complex salt, which includes, for example, iridium trichloride, iridium tetrachloride, potassium hexachloroiridate (III), potassium hexachloroiridate (IV), and ammonium hexachloroiridate (III).

The known processes such as a sulfur sensitization, a reduction sensitization, and a gold sensitization, can be used as a chemical sensitization for the monodispersed emulsion used in the present invention. They can be used singly or in combination thereof. The preferred chemical sensitizing process is the sulfur sensitization.

As a sulfur sensitizer, various sulfur compounds may be used, for example, thiosulfates, thioureas, thiazoles, and rhodanines as well as the sulfur compounds contained in gelatin. The specific examples thereof are those described in U.S. Pat. Nos. 1,574,944, 2,278,947, 2,410,689, 2,728,668, 3,501,313, and 3,656,955. The preferred sulfur compounds are thiosulfate and a thiourea compound. pAg in the chemical sensitization falls preferably within the range of 8.3 or less, more preferably 7.3 to 8.0. Further, as reported by Moisar, Klein Gelatine. Proc. Syme. 2nd, 301 to 309 (1976), a process in which polyvinylpyrrolidone and thiosulfate are used in combination gives a good result as well.

Among the noble metal sensitizing processes, the gold sensitizing process is a typical one and a gold compound, mainly a gold complex salt is used. There may be contained as well the noble metals other than gold, for example, the complex salts of platinum, palladium, and iridium. The specific examples thereof are described in U.S Pat. No. 2,448,060 and British Patent 618,061.

In the present invention, the silver halide emulsion particularly suitable for a light-sensitive material for a dot to dot work is of silver halide comprising silver chloride of 90 mole % or more, more preferably 95 mole % or more and silver bromochloride or silver bromochloride containing 0 to 10 mole % of silver bromide. The increase in a proportion of silver bromide or silver iodide is not preferred since a safelight safety in a daylight is deteriorated or $\gamma$ is lowered.

The silver halide emulsion of the present invention contains preferably a transition metal complex. Rh, Ru, Re, Os, Ir, and Cr can be enumerated as the transition metal.

There can be enumerated as a ligand, the nitrosyl and thionitrosyl crosslinking ligands, a halide ligand (fluoride, chloride, bromide and iodide), a cyanide ligand, a cyanate ligand, a thiocyanate ligand, a selenocyanate ligand, a tellurocyanate ligand, an acid ligand, and an aquo ligand. In the case where the aquo ligand is present, it occupies preferably one or two of the ligands.

To be concrete, a rhodium atom can be converted to an arbitrary form of a metal salt such as a single salt and. a complex salt to add it in the preparation of the grains.

Example of the rhodium salt includes, rhodium monochloride, rhodium dichloride, rhodium trichloride, and ammonium hexachlororhodate. Preferred is a water soluble trivalent rhodium halogen complex compound, for example, hydrogen hexachlororhodate (III) or the salt thereof (an ammonium salt, a sodium salt and a potassium salt).

These rhodium salts are used in the addition amount falling within the range of $1.0\times10^{-6}$ to $1.0\times10^{-3}$ mole, preferably $1.0\times10^{-5}$ to $1.0\times10^{-3}$ mole, particularly preferably $5.0\times10^{-5}$ to $5.0\times10^{-4}$ mole per mole of silver halide.

Further, the following transit metal complexes are preferred as well:

1. $[Ru(NO)Cl_5]^{-2}$
2. $[Ru(NO)_2Cl_4]^{-1}$
3. $[Ru(NO)(H_2O)Cl_4]-1$
4. $[Ru(NO)Cl_5]^{-2}$
5. $[Rh(NO)Cl_5]^{-2}$
6. $[Re(NO)Cl_5]^{-2}$
7. $[Re(NO)ClCN_4]^{-2}$
8. $[Rh(NO)_2Cl_4]^{-1}$
9. $[Rh(NO)(H_2O)Cl]^{-1}$
10. $[Ru(NO)CN_5]^{-2}$
11. $[Ru(NO)Br_5]^{-2}$
12. $[Rh(NS)Cl_5]^{-2}$
13. $[Os(NO)Cl_5]^{-2}$
14. $[Cr(NO)Cl_5]^{-3}$
15. $[Re(NO)Cl_5]^{-1}$
16. $[Os(NS)Cl_4(TeCN)]^{-2}$
17. $[Ru(NS)I_5]^{-2}$
18. $[Re(NS)Cl_4(SeCN)]^{-2}$
19. $[Os(NS)Cl(SCN)_4]^{-2}$
20. $[Ir(NO)Cl_5]^{-2}$

Various additives used in the light-sensitive material of the present invention are not specifically limited, and those described in the following table can be preferably used.

| Item | Corresponding portion |
|---|---|
| 1) Nucleus-forming accelerator | Formula (II-m) or (II-p) and the compound example II-1 or II-22 at p. 9, right upper column, line 13 to p. 16, left upper column, line 10 of JP-A-2-103536; and the compounds described in JP-A-1-179939. |
| 2) Spectral sensitizing dye which may be used in combination | p. 8, left lower column, line 13 to right lower column, line 4 of JP-A-2-12236; p. 16, right lower column, line to p. 17, left lower column, line 20 of JP-A-2-103536; and further the spectral sensitizing dyes described in JP-A-1-112235, JP-A-2-124560, JP-A-3-7928, JP-A-3-189532, and 3-411064. |
| 3) Surface active agent | p. 9, right upper column, line 7 to right lower column, line 7 of JP-A-2-12236; and p. 2, left lower column, line 13 to p. 4, right lower column, line 18 of JP-2-18542. |
| 4) Anti-fogging agent | p. 17, right lower column, line 19 to p. 18, right upper column, line 4 and right lower column, lines 1 to 5 of JP-A-2-103526; and further the thiosulfinic acid compounds described in JP-A-1-237538. |

-continued

| Item | Corresponding portion |
|---|---|
| 5) Polymer latex | p. 18, left lower column, lines 12 to 20 of JP-A-2-103536. |
| 6) Compound having an acid group | p. 18, right lower column, line 6 to p. 19, left upper column, line 1 of JP-A-2-103536. |
| 7) Matting agent, lubricant and plasticizer | p. 19, left upper column, line 15 to right upper column, line 15 of JP-A-2-103536. |
| 8) Hardener | p. 18, right upper column, lines 5 to to 17 of JP-A-2-103536. |
| 9) Dye | dyes described at p. 17, right lower column, lines 1 to 18 of JP-A-2-103536; and solid dyes described in JP-A-2-294638 and JP-A-5-11382. |
| 10) Binder | p. 3, right lower column, lines 1 to 20 of JP-A-2-18542. |
| 11) Anti-black pepper agent | the compounds described in U.S. Pat. 4,956,257, and JP-A-1-118832. |
| 12) Monomethylene compound | the compounds of Formula (II) (particularly the compound example II-1 or II-26) described in JP-A-2-287532. |
| 13) Dihydroxybenzenes | p. 11, left upper column to p. 12 left lower column of JP-A-3-39948; and the compounds described in EP 452772A. |

The present invention will be explained in more detailed below with reference to the examples but the present invention will not be limited thereto.

EXAMPLE 1

An aqueous gelatin solution containing $1.5\times10^{-4}$ mole/liter of 1,3-dimethyl-2-imidazolidinethione and $7\times10^{-2}$ mole/liter of sodium chloride was maintained at 40° C. and mixed thoroughly. To this solution, an aqueous solution of sodium chloride and sodium bromide (containing potassium hexachloroiridate (III) of $2\times10^{-7}$ mole and ammonium hexachlororhodate (III) of $3\times10^{-7}$ mole each per mole of silver) and a silver nitrate aqueous solution were mixed by a double jet process over a period of 30 minutes, to thereby prepare a silver bromochloride emulsion (silver bromide content: 30 mole %) having an average grain size of 0.25 μm in a form of a monodispersed cube (fluctuation coefficient: 9.5%).

After completing a grain formation, the emulsion was washed according to a conventional method to remove soluble salts. Then, gelatin was added and sodium chloride, sodium bromide and sodium hydroxide were further added so that pAg and pH were set at 7.5 and 6.0, respectively, followed by adding sodium sulfate of $2\times10^{-5}$ mole and potassium chloraurate of $3\times10^{-5}$ mole each per mole of silver to this emulsion to provide a chemical sensitization at 60° C. for 40 minutes.

After carrying out the chemical sensitization, the compound (a) was added by $1\times10^{-3}$ mole per mole of silver to prepare the emulsion A. The following compound (b) was added by $5\times10^{-4}$ mole per mole of silver to the emulsion A as a sensitizing dye.

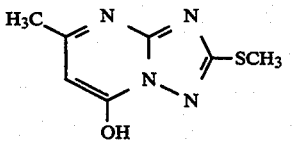

Compound (a)

-continued

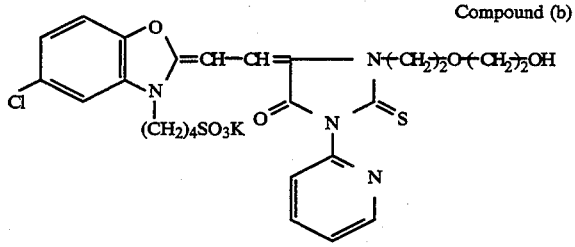

Compound (b)

Further, the hydrazine compounds H-10, H-17 and H-20 of Formula (I) were added by $6\times10^{-4}$ mole per mole of silver to prepare the emulsions $A_1$, $A_2$ and $A_3$, respectively. Further, there were added to the respective emulsions, the amino compound represented by (c) of $4\times10^{-3}$ mole per mole of silver, the mercapto compound represented by (d) of $4\times10^{-4}$ mole per mole of silver, 5-methylbenzotriazole of $1\times10^{-3}$ mole per mole silver, the polyethyl acrylate compound described in the manufacturing procedure of U.S. Pat. No. 3,525,620 to 0.8 g per 1 $m^2$ as a polymer latex, sodium p-dodecylbenzenesulfonate to 40 mg per 1 $m^2$ as a coating aid, and 1,3-divinylbenzene to 100 mg per 1 mas a hardener. The emulsions thus prepared were coated on a subbed polyethylene terephthalate support having a dye layer having an absorption in blue to green on a back face side to a silver amount of 3.4 g per 1 $m^2$.

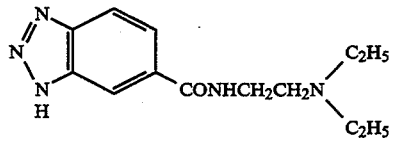

Compound (c)

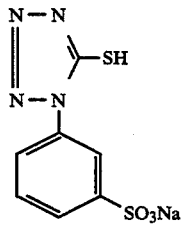

Compound (d)

A gelatin layer was coated as a protective layer on a silver halide emulsion layer. Gelatin of the protective layer was adjusted to 1.2 g per 1 $m^2$ and there were incorporated into the protective layer, amorphous $SiO_2$ of 40 mg/$m^2$ having an average particle size of 3.5 μm as a matting agent, silicon oil of 20 mg/$m^2$ sodium p-dodecylbenzene-sulfonate of 60 mg/$m^2$ as a clating aid, and a fluorine series surface active agent represented by (e) of 5 mg/$m^2$.

The samples prepared from the emulsions A1, A2 and A3 were designated as Samples B, C and D, and the sample containing no hydrazine compound was designated as Sample A.

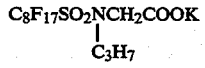

Compound (e)

The composition of the developing solution will be shown bellow.

| (Developing Solution) | |
|---|---|
| Potassium hydroxide | 35.0 g |
| Diethylenetriaminepentaacetic acid | 2.0 g |
| Sodium metabisulfate | 40.0 g |
| Potassium carbonate | 12.0 g |
| Potassium bromide | 3.0 g |
| 5-Methylbenzotriazole | 0.06 g |
| 2,3,5,6,7,8-Hexahydro-2-thioxo-4-(1H)-quinazolinone | 0.04 g |
| Sodium 2-mercaptobenzimidazole-5-sulfonate | 0.15 g |
| Hydroquinone | 25.0 g |
| 4-Hydroxymethyl-4-methyl-phenyl-3-pyrazoline | 0.45 g |
| pH (adjusted by adding potassium hydroxide) | 10.5 |
| Water was added to | 1 liter |

The developing solutions for a test as shown in Table 1 were prepared on the basis of this developing solution.

TABLE 1

| Developing Solution No. | Compound Formula (II) Compound No. | Compound Formula (II) Add amount | Formula (II)/HQ mole ratio |
|---|---|---|---|
| 1 (Comp.) | — | — | — |
| 2 (Inv.) | II-1 | 2.5 g/l | 0.0625 |
| 3 (Inv.) | II-3 | 3.0 g/l | 0.0717 |
| 4 (Inv.) | II-8 | 3.0 g/l | 0.0714 |
| 5 (Inv.) | II-18 | 2.5 g/l | 0.0509 |
| 6 (Comp.) | II-1 | 0.5 g/l | 0.0125 |
| 7 (Comp.) | II-1 | 6.0 g/l | 0.1500 |

The respective samples, thus prepared, were exposed to tungsten light of 3200° K. through an optical wedge for sensitometry for 5 seconds, and after developing in the developing solution of the composition described above at 35° C. for 30 seconds, followed by fixing, washing and drying processings thereon. GR-F1 manufactured by Fuji Photo Film Co., Ltd. was used as a fixing solution.

Next, these samples were used to carry out a running experiment.

A running condition was such that.there was carried out three times running tests, each of which comprises 6 days operation and 1 day recess that 30 sheets of the respective each film having a 50.8×61.0 cm size, subjected to 80% blackening (8 sheets of 10 sheets were exposed to light) were processed.

A replenishing amount was 100 ml per film both in developing and fixing baths.

A sensitivity was shown by a relative value of a reciprocal of an exposure giving a density of 1.5.

A $\gamma$ value was applied as an indicator showing a contrast of an image, wherein the $\gamma$ value was expressed by a gradient of a linear line obtained by connecting points of fog+density 0.3 and of fog+density 3.0. That is, $\gamma=(3.0-0.3)/[\log$ (an exposure giving density 3.0)$-\log$ (an exposure giving density 0.3)], and it is shown that the larger the $\gamma$ value is, the harder the photographic characteristic is.

A black pepper was evaluated by five grades by observing an image portion with an optical loupe after processing at 35° C. for 30 seconds. Grade [5] shows the best level at which the black pepper is not generated; Grade [1] shows the worst level at which the black pepper is markedly generated; and Grade [3] is a limit level at which the generation of the black pepper is practically allowable.

TABLE 2

| Test No. | Film No. | Developing solution No. | Running performance: Photographic performance | Running performance: Fresh solution | Running performance: Last | Black pepper |
|---|---|---|---|---|---|---|
| 1 (Comp.) | A | 1 | Fog | 0.04 | 0.04 | |
| | | | Gradation | 7.10 | 7.50 | 5 |
| | | | Sensitivity | 76 | 79 | |
| 2 (Comp.) | B | 1 | Fog | 0.04 | 0.05 | |
| | | | Gradation | 23.0 | 20.6 | 2 |
| | | | Sensitivity | 100 | 112 | |
| 3 (Comp.) | D | 1 | Fog | 0.04 | 0.05 | |
| | | | Gradation | 24.6 | 22.1 | 2 |
| | | | Sensitivity | 110 | 122 | |
| 4 (Comp.) | A | 2 | Fog | 0.04 | 0.04 | |
| | | | Gradation | 7.05 | 7.24 | 5 |
| | | | Sensitivity | 78 | 80 | |
| 5 (Inv.) | B | 2 | Fog | 0.04 | 0.04 | |
| | | | Gradation | 22.3 | 21.0 | 5 |
| | | | Sensitivity | 102 | 100 | |
| 6 (Inv.) | C | 2 | Fog | 0.04 | 0.04 | |
| | | | Gradation | 21.2 | 20.7 | 5 |
| | | | Sensitivity | 99 | 98 | |
| 7 (Inv.) | D | 2 | Fog | 0.04 | 0.04 | |
| | | | Gradation | 26.4 | 26.0 | 5 |
| | | | Sensitivity | 105 | 101 | |
| 8 (Inv.) | D | 3 | Fog | 0.04 | 0.04 | |
| | | | Gradation | 24.9 | 23.2 | 4 |
| | | | Sensitivity | 108 | 104 | |
| 9 (Inv.) | D | 4 | Fog | 0.04 | 0.04 | |
| | | | Gradation | 23.0 | 21.8 | 5 |
| | | | Sensitivity | 106 | 102 | |
| 10 (Inv.) | D | 5 | Fog | 0.04 | 0.04 | |
| | | | Gradation | 22.8 | 21.4 | 5 |
| | | | Sensitivity | 102 | 100 | |
| 11 (Comp.) | D | 6 | Fog | 0.04 | 0.05 | |
| | | | Gradation | 24.2 | 21.2 | 2 |
| | | | Sensitivity | 101 | 110 | |
| 12 (Comp.) | D | 7 | Fog | 0.04 | 0.05 | |
| | | | Gradation | 24.3 | 9.53 | 5 |

TABLE 2-continued

| Test No. | Film No. | Developing solution No. | Running performance: Photographic performance | Fresh solution | Last | Black pepper |
|---|---|---|---|---|---|---|
| | | | Sensitivity | 103 | 81 | |

As apparent from the results summarized in Table 2, the films B, C and D each containing the hydrazine compound of the present invention incorporated into the light-sensitive material could provide the high contrast (γvalue: 10 or more) images even with a processing with the developing solution having pH of 10.5.

Further, the comparison of a black pepper generated in a running test showed that the developing solutions (NO. 2, 3, 4 and 5) to which the compounds of the present invention (Formula II) were added scarcely generated the black peppers and provided a smaller change in a photographic performance.

It was found in the test Nos. 1, 2, 3, 4, 11, and 12 that the high contrast images could not be obtained in the photographic performance with a fresh solution or a running solution or that a lot of the black peppers were generated in the running test.

It was found from the above results that the embodiment of the present invention could provide the high contrast images even with the developing solution of a low pH value and that the generation of the black pepper due to running was decreased.

EXAMPLE 2

The samples E, F, G and H were prepared in the same manner as that in Example 1, except that the sensitizing dye (Compound b) was changed to the following compound (f) and added in an amount of $5\times10^{-4}$ mole per mole of silver and that the amino compound (Compound c) was changed to the following compound (G) and added in an amount of $2\times10^{-3}$ mole per mole of silver.

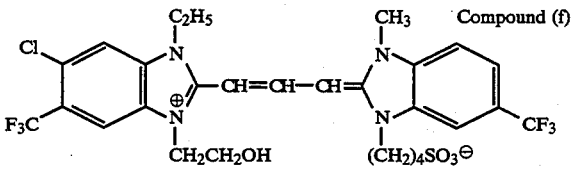

-continued

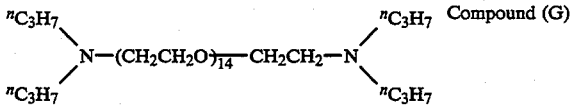

| Composition of the developing solution: | |
|---|---|
| Potassium hydroxide | 30.0 g |
| Diethylenetriaminepentaacetate | 2.0 g |
| Sodium metabisulfate | 40.0 g |
| Potassium carbonate | 12.0 g |
| Potassium bromide | 3.0 g |
| 5-Methylbenzotriazole | 0.08 g |
| 2,3,5,6,7,8-Hexahydro-2-thioxo-4-(1H)-quinazolinone | 0.04 g |
| Sodium 2-mercaptobenzimidazole-5-sulfonate | 0.15 g |
| Hydroquinone | 25.0 g |
| 4-Hydroxymethyl-4-methyl-l-phenyl-3-pyrazolidone | 0.45 g |
| N-n-butyldiethanolamine | 4.0 g |
| N,N-dimethyl-6-hydroxy-n-hexylamine | 2.0 g |
| pH (adjusted by adding potassium hydroxide) | 10.3 |
| Water was added to | 1 liter |

TABLE 3

| Developing solution No. | Compound of Formula (II): Compound No. | Add amount |
|---|---|---|
| 8 (Comp.) | — | — |
| 9 (Inv.) | II-1 | 2.5 g/l |
| 10 (Inv.) | II-3 | 3.0 g/l |
| 11 (Inv.) | II-8 | 3.0 g/l |
| 12 (Inv.) | II-18 | 2.5 g/l |

This test sample and the test developing solutions were used to carry out the same experiments as those in Example 1 to obtain the results summarized in Table 4.

TABLE 4

| Test No. | Film No. | Developing solution No. | Running performance: Photographic performance | Fresh solution | Last | Black pepper |
|---|---|---|---|---|---|---|
| 13 (Comp.) | E | 8 | Fog | 0.04 | 0.04 | |
| | | | Gradation | 6.82 | 6.955 | |
| | | | Sensitivity | 78 | 83 | |
| 14 (Comp.) | F | 8 | Fog | 0.04 | 0.05 | |
| | | | Gradation | 19.8 | 22.6 | 2 |
| | | | Sensitivity | 100 | 116 | |
| 15 (Comp.) | H | 8 | Fog | 0.04 | 0.05 | |
| | | | Gradation | 23.5 | 24.1 | 2 |
| | | | Sensitivity | 108 | 111 | |
| 16 (Comp.) | E | 9 | Fog | 0.04 | 0.04 | |
| | | | Gradation | 6.75 | 6.54 | 5 |
| | | | Sensitivity | 74 | 74 | |
| 17 (Inv.) | F | 9 | Fog | 0.04 | 0.04 | |
| | | | Gradation | 20.3 | 19.5 | 4 |
| | | | Sensitivity | 103 | 100 | |
| 18 (Inv.) | G | 9 | Fog | 0.04 | 0.04 | |
| | | | Gradation | 21.2 | 20.5 | 5 |
| | | | Sensitivity | 98 | 96 | |
| 19 (Inv.) | H | 9 | Fog | 0.04 | 0.04 | |
| | | | Gradation | 25.7 | 24.2 | 5 |

TABLE 4-continued

| Test No. | Film No. | Developing solution No. | Running performance: Photographic performance | Fresh solution | Last | Black pepper |
|---|---|---|---|---|---|---|
| | | | Sensitivity | 104 | 101 | |
| 20 (Inv.) | H | 10 | Fog | 0.04 | 0.04 | |
| | | | Gradation | 24.3 | 23.5 | 4 |
| | | | Sensitivity | 105 | 100 | |
| 21 (Inv.) | H | 11 | Fog | 0.04 | 0.04 | |
| | | | Gradation | 22.2 | 21.3 | 4 |
| | | | Sensitivity | 106 | 103 | |
| 22 (Inv.) | H | 12 | Fog | 0.04 | 0.04 | |
| | | | Gradation | 22.3 | 21.1 | 4 |
| | | | Sensitivity | 104 | 100 | |

It was found that similarly to Example 1, the process of the present invention could provide the high contrast images even with the developing solutions of a lower pH value and that the generation of the black pepper was decreased.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide photographic material having a support thereon comprising at least one silver halide emulsion layer and containing a hydrazine compound represented by the following formula (I) in the above emulsion layer or another hydrophilic colloid layer, which comprises processing the silver halide photographic material after exposure in a developing solution containing:

(1) 0.2 to 0.75 mole/liter of a dihydroxybenzene developing agent, (2) 0.001 to 0.06 mole/liter of a 1-phenyl-3-pyrazolidone and/or p-aminophenol auxiliary developing agent, (3) 0.3 to 1.2 mole/liter of a free sulfite ion, and (4) a compound represented by the following formula (II), and having a concentration ratio of a compound represented by formula (II) to a dihydroxy developing agent of 0.03 to 0.12 and pH of 9.0 to 11.0:

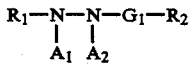

(I)

wherein $R_1$ represents an aliphatic group, an aromatic group, or a heterocyclic group; $R_2$ represents a hydrogen atom, an alkyl group, an aryl group, an alkoxy group, an aryloxy group, an amino group, or a hydrazino group; $G_1$ represents a carbonyl group, a sulfonyl group, a sulfoxy group, a —P(O)($R_3$)— group ($R_3$ is synonymous with $R_2$), a —C(O)C(O)— group, a thiocarbonyl group, or an iminomethylene group; and both of $A_1$ and $A_2$ represent a hydrogen atom, or either of $A_1$ and $A_2$ represents a hydrogen atom and another represents an alkylsulfonyl group, an arylsulfonyl group, or an acyl group:

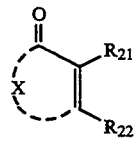

(II)

wherein $R_{21}$ and $R_{22}$ each represents a hydroxy group, an amino group, an acylamino group, an alkylsulfonylamino group, an arylsulfonylamino, an alkoxycarbonylamino group, a mercapto group, or an alkylthio group; and X represents atoms necessary to form a 5- or 6-membered ring together with two vinyl carbon atoms substituted with $R_{21}$ and $R_{22}$ and a carbonyl carbon atom; wherein the silver halide emulsion layer has a silver chloride content of 60 mol % or more.

2. The method as claimed in claim 1, wherein the hydrazine compound of formula (I) is contained in an amount of $1\times10^{-6}$ to $5\times10^{-2}$ mol/mol Ag.

3. The method as claimed in claim 1, wherein $R_1$ in formula (I) is a group represented by formula (b)

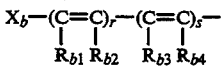

(b)

wherein $X_b$ represents an aromatic group or a nitrogen-containing heterocycle group; $R_{b1}$ to $R_{b4}$ each represents a hydrogen atom, a halogen atom, or an alkyl group; $X_b$ and $R_{b1}$ to $R_{b4}$ may have a substituent; and rand s ach represents 0 or 1.

4. The method as claimed in claim 1, wherein a substituent of $R_1$ group is a group represented by formula (c)

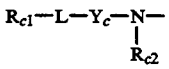

(c)

wherein $Y_c$ represents —CO—, —$SO_2$—, —P(O)($R_{c3}$)— (wherein $R_{c3}$ represents an alkoxy group or an aryloxy group), or —OP(O)($R_{c3}$)—; L represents a single bond, —O—, —S—, or —$NR_{c4}$— (wherein $R_{c4}$ represents a hydrogen atom, an alkyl group, or an aryl group); and $R_{c1}$ and $R_{c2}$ each represents a hydrogen atom, an aliphatic group, an aromatic group, or a heterocycle and may be the same or different, or may be combined with each other to form a ring.

5. The method as claimed in claim 1, wherein the compound of formula (II) is an ascorbic acid or erysorbic acid (stereoisomer) represented by formula (II-1);

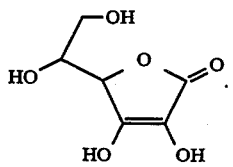

(II-1)

6. The method as claimed in claim 1, wherein the concentration ratio of the compound of formula (II) to dihydroxy developing agent is 0.03 to 0.10 mol/l.

7. The method as claimed in claim 1, wherein the hydrazine compound is represented by formula (III);

$$R_1-\underset{\underset{A_1}{|}}{N}-\underset{\underset{A_2}{|}}{N}-G_1-R_2 \qquad (I)$$

wherein $R_1$ represents aliphatic or aromatic groups which have a partial constituent of $-O-(CH_2CH_2O)_n-$, $-O-(CH_2CH(CH_3)O)_n-$ or $-O-(CH_2CH(OH)CH_2O)_n-$ (wherein n is an integer of 3 or more) as a part of the substituent, or contain quaternary ammonium cation; $G_1$ represents —CO—, —COCO—, —CS—, —C(=$NG_2R_2$)—, —SO—, —$SO_2$— or P(O)($G_2R_2$)— group (wherein $G_2$ is a mere connecting group, —O—, —S—, or —N($R_2$)— group); and $R_2$ represents aliphatic or aromatic group hydrogen atom, with proviso that when a plural $R_2$ is present in a molecule, these may be the same or different, and at least one of $A_1$ and $A_2$ is a hydrogen atom and the other is a hydrogen atom, an acyl group, an alkyl group or an arylsulfonyl group.

8. The method as claimed in claim 1, wherein the hydrazine compound is represented by formula (IV); wherein $R_1$ represents aliphatic, aromatic or heterocyclic group, which may be substituted; G represents —CO—, —$SO_2$—, —SO—, —COCO—, thiocarbonyl, iminomethylene group or —P(O)($R_3$)group; and $R_2$ represents a substituted alkyl group, in which a carbon atom substituted by group G is further substituted with at least one electron withdrawing group; and $R_3$ represents a hydrogen atom, aliphatic group, aromatic group, an alkoxy group, an aryloxy group or an amino group.

* * * * *